US005438902A

United States Patent [19]

Baker

[11] Patent Number: 5,438,902

[45] Date of Patent: Aug. 8, 1995

[54] MEMORY TUNING SYSTEM FOR STRINGED INSTRUMENTS

[76] Inventor: Michael V. Baker, 4606 51A Street, Camrose, Alberta, Canada, T4V 1T3

[21] Appl. No.: 83,302

[22] Filed: Jun. 29, 1993

[51] Int. Cl.[6] ..... G10D 3/14

[52] U.S. Cl. ..... 84/312 R; 84/313

[58] Field of Search ..... 84/312 R, 313, 297 R, 84/298, 299, 307

[56] References Cited

U.S. PATENT DOCUMENTS

| | | | |
|---|---|---|---|
| Re. 32,863 | 2/1989 | Edwards | 84/314 |
| 3,250,167 | 5/1966 | Porter | 84/313 |
| 3,411,394 | 11/1968 | Jones | 84/313 |
| 3,479,917 | 11/1969 | Zitnik, Jr. et al. | 84/312 R |
| 4,171,661 | 10/1979 | Rose | 84/313 |
| 4,497,236 | 2/1985 | Rose | 84/298 |
| 4,549,461 | 10/1985 | Rose | 84/313 |
| 4,555,970 | 12/1985 | Rose | 84/313 |
| 4,572,049 | 2/1986 | Tanaka et al. | 84/313 |
| 4,632,005 | 12/1986 | Steinberger | 84/313 |
| 4,656,915 | 4/1987 | Osuga | 84/313 |
| 4,677,891 | 7/1987 | Gressett, Jr.; et al. | 84/313 |
| 4,686,883 | 8/1987 | Piche et al. | 84/313 |
| 4,690,027 | 9/1987 | Ido | 84/298 |
| 4,690,028 | 9/1987 | Steinberger | 84/314 N |
| 4,704,936 | 11/1987 | Steinberger | 84/313 |
| 4,724,737 | 2/1988 | Fender | 84/313 |
| 4,742,750 | 5/1988 | Storey | 84/313 |
| 4,748,889 | 6/1988 | Schaller | 84/304 |
| 4,796,505 | 1/1989 | Takenchi | 84/313 |
| 4,878,413 | 11/1989 | Steinberger | 84/314 |
| 4,882,967 | 11/1989 | Rose | 84/313 |
| 4,892,025 | 1/1989 | Steinberger | 84/313 |
| 4,944,208 | 7/1990 | Kusek | 84/313 |
| 4,955,275 | 9/1990 | Gunn | 84/313 |
| 4,967,631 | 11/1990 | Rose | 84/313 |
| 5,083,492 | 1/1992 | Gorr | 84/313 |

FOREIGN PATENT DOCUMENTS 441058 3/1912 France .

OTHER PUBLICATIONS

"Transperformance's DTS-1; Alternate Tuning Nirvana", *Guitar Player,* Mar. 1993.

Hipshot Music Products, A Division of Borisoff Engineering.

*Primary Examiner*—Michael L. Gellner
*Assistant Examiner*—Cassandra Spyrou

[57] ABSTRACT

The present invention relates to a memory tuning system for use with stringed instruments. The system includes a main activator cam having a series of adjustable projection set screws located around its circumference. Each string of the instrument is connected to a compound lever assembly and rests against the cam. The compound lever assembly consists of a tuning lever and a separator lever both pivotally mounted to a frame assembly. A fine tuning adjustment screw is tapped into the tuning lever, but not through the separator lever. In the bridge mounted version, each string is clamped into a rotatable block assembly to allow for various tensions to be applied to the string. The lever assembly is interconnected to the block assembly to control the tension of the string based on either the adjustment screw position or the set screw position. The set screws on the activator cam allow the player to pre-set a plurality of pitch tunings that can be instantly recalled by merely rotating the cam, thereby causing the lever assembly to rotate, which in turn increases or decreases the tension in the strings.

35 Claims, 7 Drawing Sheets

MEMORY TUNING SYSTEM FOR STRINGED INSTRUMENTS

FIELD OF THE INVENTION

This invention relates to the field of stringed musical instruments, and more specifically to systems capable of employing alternate pitch tuning arrangements for the instrument.

BACKGROUND OF THE INVENTION

In the field of stringed musical instruments, such a guitars, the strings of the instrument extend between two critical contact points, typically provided at the nut of the instrument and at the bridge of the instrument. Each string also extends beyond at least one of the critical contact points where it is secured to a tuning peg or tuning machine provided on the instrument for adjusting the tension of the string. The other end of the string also generally extends beyond the other control contact point so as to be anchored to the instrument.

The sound produced by each of the strings is affected both by the string length between the critical contact points and by the tension on the string. Generally, a string of a musical instrument may be both pitch and harmonically tuned individually and independently of the other strings of the musical instrument, whereby:

1. Pitch or Fine Tuning: is accomplished by increasing or decreasing the tension on a given string, thereby raising and lowering, respectively, the pitch of the string; and
2. Harmonic or String Tuning: is accomplished by altering the distance between the points at which a given string contacts the bridge and nut elements of the instrument.

Many guitar players use an alternate tuning or tunings during their play in which it is necessary to adjust the pitch tuning of the strings of the guitar. Currently, players may use extra guitars, one of which would be reserved for use in music that employed "open" tunings. Essentially an open or chord tuning occurs when the standard (E-A-D-G-B-E) tuning is changed to (D-G-D-G-B-D). However, the average musician cannot necessarily afford to have a separate guitar for each tuning.

Changing the tuning of the guitar in the middle of a performance or in the middle of a song is an option, but such a mid-song/performance re-tuning is used generally to change the pitch of just one string and it would be almost impossible to accurately re-tune all strings to a desired pitch tuning.

The harmonic or dramatic pitch tuning of a guitar can be altered by the use of a tremolo device. The purpose of a tremolo device is to allow a guitarist to alter an existing string tone, by increasing or decreasing the string tension. A tremolo device is commonly used to produce unusual tone variations or special sound effects. A tremolo device is typically anchored to the face of the guitar, and includes the bridge end of the strings. The other end of the strings is connected to a nut, which is near the position where the strings may be tightened or loosened by customary means.

Typically, a moving tailpiece on the body of the guitar is used to accomplish the tension change. In such a mechanism, a pivot point is established and the tailpiece pivots about that point. A spring may be utilized to counteract the pull of the strings on the tailpiece. A handle is generally provided for pivoting the tailpiece while simultaneously playing the instrument.

A tremolo apparatus is not capable of retaining a number of preset tunings that can be recalled during a performance. It is merely used to instantaneously and temporarily change the tension in the strings.

Special string clamping devices have been used to clamp the strings of a musical instrument in order to anchor the ends of the strings and to prevent sliding movement of the strings over the nut and the bridge of the instrument when a tremolo mechanism is used. These devices are used to increase the length of time an instrument will remain pitch tuned.

However, existing clamping systems can only retain one preset tuning arrangement. If the musician wants to modify the tuning each of the strings must be individually re-tuned by using a fine tuning adjustment screw.

PRIOR ART

String clamping and fine tuning systems are disclosed in, for example, U.S. Pat. Nos. 4,549,461; and 4,967,631 issued Oct. 29, 1985 and Nov. 6, 1990, respectively, to Floyd D. Rose. These clamping systems are principally designed to maintain the tuning of the instrument when a tremolo device is used. They also include a fine tuning adjustment means that modifies the pitch tuning of individual strings. However, these systems are intended to lock only one alternate tuning of the guitar strings.

For steel and some lap guitars the pitch tuning of the strings can be altered during a performance by the use of pedals. However, these instruments do not have frets to allow for normal playing styles. In addition, the pedals must generally be depressed in an alternate tuning to maintain the changed pitch tuning and as a result this system may not stay in accurate tune for sustained periods.

Digital memory tuning systems have been proposed that permit a large number of alternate tunings. The systems typically incorporate a servo-motor bridge system that transposes or changes tunings as you play. Each string of the instrument is connected to its own motor, allowing it to move individually and in contrary motion to the others. Digital tuning systems currently require major reconstruction of the instrument and can only be mounted on specific guitars having a thickness greater than 1.5 inches. The system is only accurate to within $\pm 3$ cents, and does not allow the use of tremolo systems in their current form.

Consequently, there is a need for a memory tuning system that (a) can be "programmed" to retain a plurality of alternate pitch tunings of the strings of an instrument; (b) can accurately recall any of the previously "programmed" tunings quickly and easily during a song or performance; (c) can be adapted to mount on or near either the nut or bridge of a guitar; (d) can incorporate fine and/or coarse tuning adjustments; and (e) can be readily adapted to work with a tremolo apparatus.

SUMMARY OF THE INVENTION

An object of the present invention is to provide a memory tuning system that can be programmed to retain a plurality of alternate pitch tunings of the strings of a stringed musical instrument.

Another object of the present invention is to provide a memory tuning system that can accurately recall a previously programmed pitch tuning quickly and easily during a song or performance.

Another object of the present invention is to provide a memory tuning system that can be mounted on or near either the nut or bridge of an existing guitar.

Another object of the present invention is to provide a memory tuning system that can be readily adapted to incorporate a tremolo apparatus.

In accordance with one aspect of the present invention there is provided a memory tuning system for a stringed instrument, wherein the stringed instrument includes a plurality of strings that are pre-tensioned between two contact points, said memory tuning system comprising: a frame assembly for connection to said instrument; a plurality of string contact means interconnected to the frame assembly, one string contact means for each string of said plurality of strings of said instrument, said plurality of string contact means contacting said strings proximate and outside one of said contact points; and adjustable string tension means in contact with said plurality of string contact means, said adjustable string tension means having a plurality of tuning positions such that at each of said tuning positions the string contact means exerts a predetermined force on each string so as to alter the tension of each string of said plurality of strings.

In accordance with another aspect of the present invention there is provided a memory tuning system for a stringed instrument having a plurality of strings, wherein each of the strings makes contact with the instrument at first and at second critical contact point, said memory tuning system comprising a frame assembly mounted to the instrument and a plurality of memory tuning units, one for each of the plurality of strings of the instrument, connected to the frame assembly, said memory tuning unit comprising: (a) string securing means connected to the frame assembly for retaining one of the strings proximate one of the critical contact points; (b) tension control means for changing the tension of one of the strings; and (c) selectively recallable means operatively connected to the tension control means, said selectively recallable means having a plurality of tuning positions such that at each of the tuning positions the selectively recallable means causes the tension control means to alter the tension of one of the strings.

BRIEF DESCRIPTION OF THE DRAWINGS

Embodiments of the invention will be described by way of example in conjunction with the drawings in which.

DETAILED DESCRIPTION OF PREFERRED EMBODIMENTS OF THE INVENTION

Figure 1:
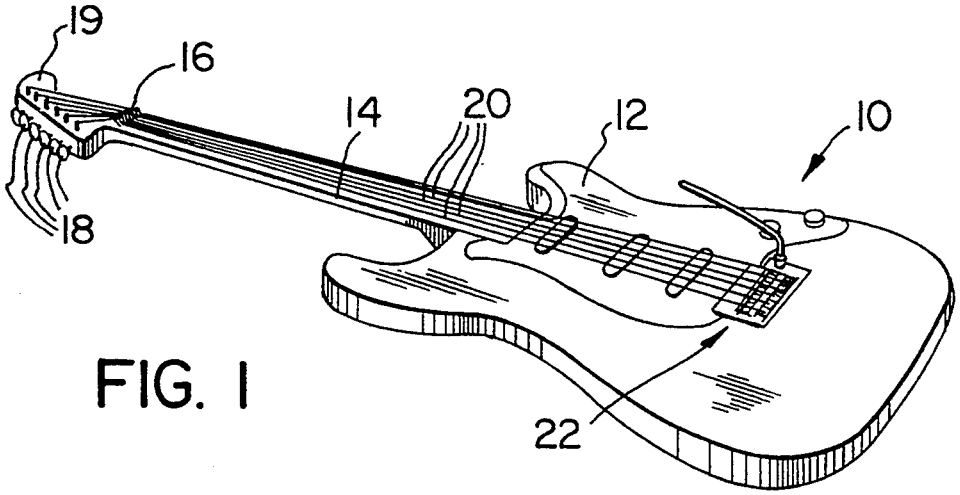
FIG. 1 is a perspective view of traditional electric guitar-type of stringed musical instrument.

FIG. 1 shows a typical electric guitar 10 generally having a body 12 and a neck 14. Near the top of the neck 14 is a nut element 16, and beyond that are several tuning pegs 18 mounted on a headstock 19. There is one tuning peg 18 for each of several strings 20. Mounted on the body 12 of the guitar 10 is a bridge element 22.

Although the present invention is discussed in use on guitars, the invention can also be used on other stringed instruments, including, for example the cello, banjo, ukulele, mandolin, and violin.

Each of the strings 20 of the guitar 10 make contact with guitar 10 at the nut 16 and at the bridge 22. The effective vibratory length of the string during play is defined as the distance between the last contact point of one of the strings 20 on the nut 16 and the first contact point on the bridge 22. These contact points defining the effective vibratory string length are commonly referred to as the critical contact points for each of the strings 20.

The strings 20 of guitar 10 can be both harmonically tuned and pitched tuned. The harmonic tune of the strings 20 may be changed by changing the distance between the critical contact points. Harmonic tuning may be accomplished, for example, by moving the bridge 22 or the critical contact point of one of the strings 20 on the bridge 22 longitudinally relative to the nut 16.

The strings 20 are pitch or fine tuned by changing the tension of the strings 20. Ideally, this should be done without changing the distance between the critical contact points, i.e. pitch tune without affecting the harmonic tune.

The present invention is concerned with "programming" a plurality of distinct pitch tunings of the strings 20 that can be recalled easily during play without the need to repeatedly re-tune the guitar strings 20.

Figure 2:
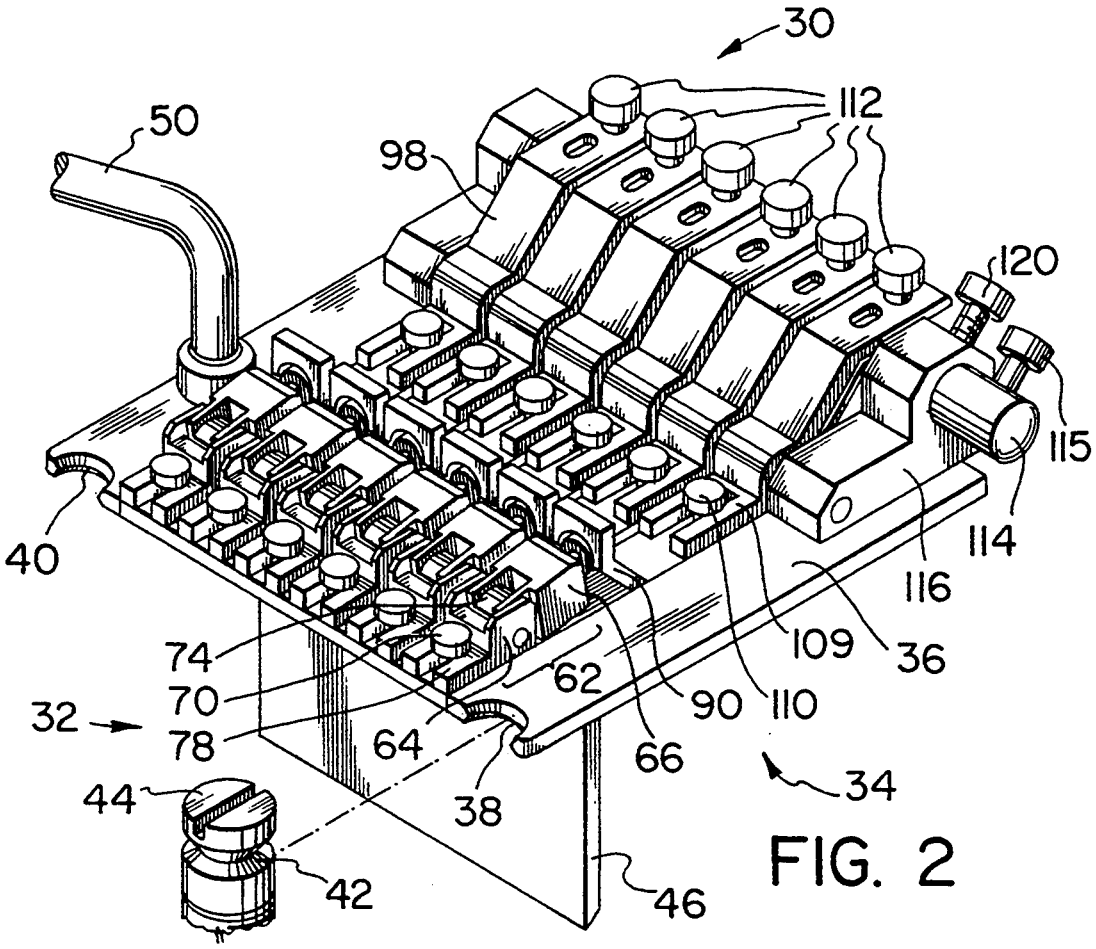
FIG. 2 is a perspective view of a bridge memory tuning system mounted on a tremolo apparatus.

FIG. 2 shows a bridge memory tuning system 30 mounted on a tremolo apparatus 32. The tremolo 32 is an optional feature of the tuning system 30 and can, in fact, be eliminated for non-tremolo guitars such as Gibson (T.M.) solid bodies and Fender Telecasters (T.M.). However, in a majority of situations a guitar player will use the tremolo 32 together with the tuning system 30 of the present invention. The bridge memory tuning system 30 can be mounted to the guitar 10 by replacing the existing bridge 22 with the entire system 30, which incorporates the basic bridge structure.

The bridge memory tuning system 30 includes a plurality of bridge tuning units 60 each of which is independently interconnected to a single string 20 of the guitar 10. An individual bridge tuning unit 60 will be discussed in detail in conjunction with FIG. 3A.

Referring specifically to FIG. 2, the present embodiment includes a tremolo base element 34, a primary part of which is a flat plate 36 that is generally aligned parallel to the top surface of the body 12 of the guitar 10. The plate 36 includes knife edge sections 38 and 40 at each of its forward corners. The knife edge sections 38 and 40 each mate with a tapered groove 42 in a position screw 44 that is fixed to the body 12 of the guitar 10.

A flange 46 extends downwardly, from the forward end of plate 36, into a cavity (not shown) in the body 12 of the guitar 10. A horizontal spring 48 (shown in FIG. 3A) connects the bottom of the flange 46 with the body 12 of the guitar 10.

A tremolo bar 50 is secured to the plate 36 near one edge. When the tremolo bar 50 is moved towards the body 12 of the guitar 10, tremolo base element 34 tilts upwardly against the action of spring 48 about the position screws 44. This action significantly changes the original pitch tune of the strings 20 and facilitates an increased range of sounds for the guitar 10. When the original pitch tune is again desired, tremolo bar 50 is released and the spring 48 returns the tremolo base element 34 to its original position.

Figure 3A:
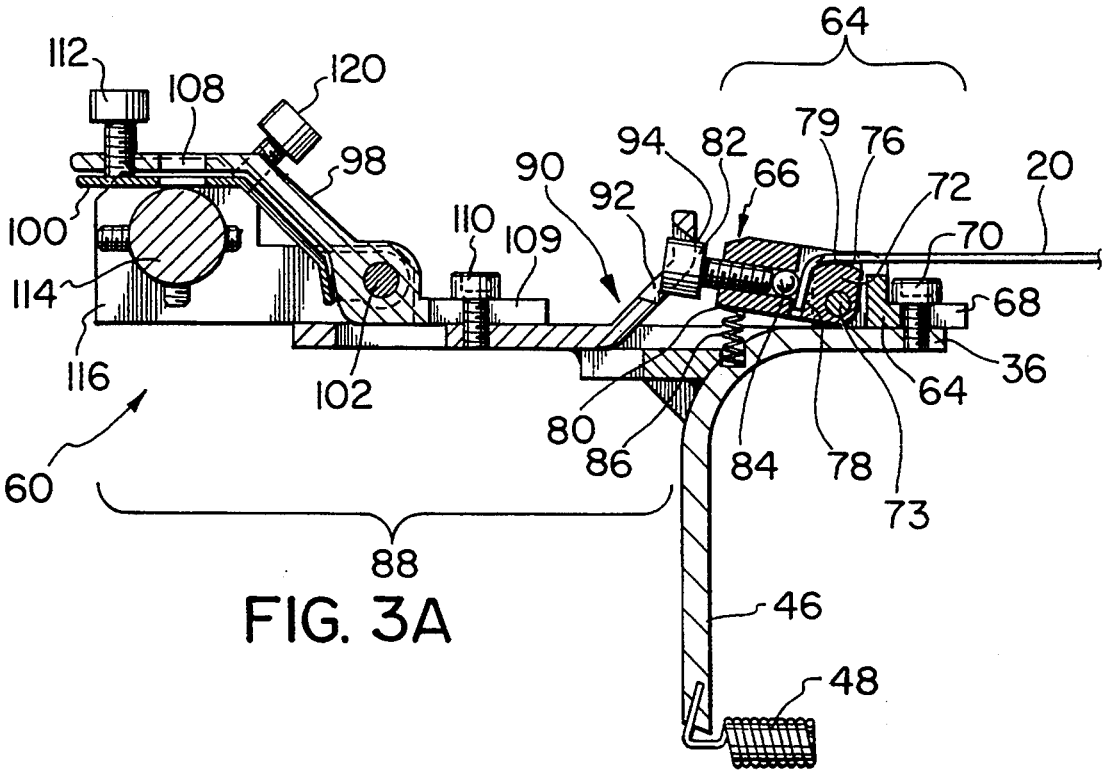
FIG. 3A is a cross-sectional view of one bridge tuning unit of the bridge memory tuning system of FIG. 2.

A cross-sectional view of one bridge tuning unit 60 of the bridge tuning system 30 is detailed in FIG. 3A. All of the units 60 (one for each of the strings on the instrument) are mounted to the base element 34. Each unit 60 includes a string clamping apparatus shown generally as element 62. The clamping apparatus 62 includes a base block element 64 and a rotatable block element 66.

The base block 64 includes a slotted plate 68 designed to accommodate a block screw 70, which is threaded into plate 36, to clamp the block 64 to the plate 36. Loosening the block screw 70 permits longitudinal movement of base block 64, for harmonically tuning one of the strings 20.

The block 66 in rotatably connected to block 64 through a pair of extension members 72 and a block axle 73. The block 66 includes a recessed region 74 (best seen in FIG. 2) for receiving one of the strings 20. The region 74 includes a semi-circular portion 76 and a substantially vertical portion 78 (in cross-section).

The critical contact point for bridge tuning unit 60 occurs in the vicinity of the top of the semi-circular portion 76 at approximately a point 79. The other critical contact point is unchanged at the nut element 16 of guitar 10.

A threaded aperture 80 for receiving a clamp screw 82 is located at one end of the block 66. The screw 82 bears against a ball bearing 84, such that when the screw 82 is advanced into the aperture 80 the ball bearing 84 is forced against one of the strings 20, thereby clamping the string 20 between the ball bearing 84 and the vertical portion 78 of block 66 to securely retain the string in the clamping apparatus 62.

The rotatable block 66 is vertically biased by means of a compression spring 86. The spring 86 is recessed into the plate 36 at one end and rests against the block 66 at the other end.

The rotatable block 66, and more particularly the head of the clamp screw 82, interacts with a rocker arm assembly, shown generally as element 88. The rocker assembly 88 includes a front stirrup 90 slidably fixed to the base element 34. The stirrup 90 is slotted to allow adjustment for different positions of the clamping apparatus 62. A tapered aperture 92 is provided to receive the head of clamp screw 82. The aperture 92 makes contact with the head of clamp screw 82 at a leverage point 94.

The rocker arm assembly 88 also includes a compound tuning lever assembly 96 consisting of a tuning lever 98 and a separator lever 100. The tuning lever 98 and the separator lever 100 are rotatably mounted to a common main axle 102. The separator lever 100 is connected to the main axle 102 by means of a rotation connector 104 that enables the separator lever 100 to have the same axis of rotation as the tuning lever 98. Each of the levers 98 and 100 have a set screw access region 108. The tuning lever 98 of the present embodiment includes a slotted extension member 109 at one end for receiving a lever screw 110 for attaching and stabilizing the stirrup 90.

A fine tuning adjustment screw 112 is threaded through the tuning lever 98 and is used to establish the base tuning of one of the strings 20.

An activator cam 114 is rotatably mounted to a trunnion 116, which is attached to the plate 36. The cam 114 includes a cam rotation lever 115 used to impart a rotational movement to the cam 114. The activator cam 114 is mounted substantially parallel to the main axle 102.

Figure 3B:
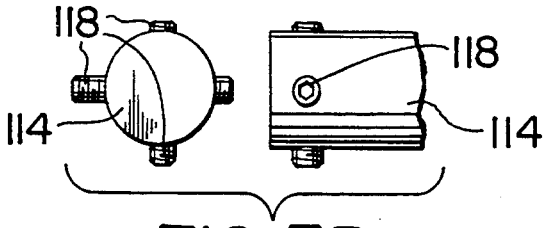
FIG. 3B is a top plan view and side plan view of an activator cam according to one embodiment of the invention.
Figure 3C:
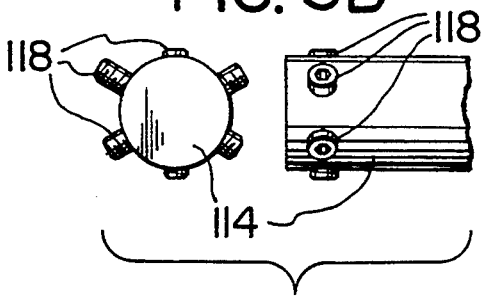
FIG. 3C is a top plan view and a side plan view of an activator cam according to another embodiment of the invention.

The cam 114 is drilled and tapped at various locations for receiving a plurality of tuning set screws 118. Two alternative set screw configurations are illustrated in FIG. 3B and 3C. FIG. 3B shows an arrangement of four set screw positions located at 90 degree intervals around the circumference of the cam 114. FIG. 3C shows an arrangement of six set screw positions staggered at 60 degree intervals around the circumference of cam 114. Staggering is generally required for internal clearance of the set screws 118 inside the cam 114 itself.

Each of the set screw positions can represent a distinct pitch tuning of one of the strings 20. The number of set screw positions is limited by the actual size of the cam 114 and the diameter of the set screws 118. Therefore, if more tuning positions are required a larger cam and/or smaller set screws 118 can be employed to provide, for example eight positions, staggered at 45 degree intervals around the circumference of cam 114. The cam 114 also includes a cam locking screw 120 to ensure that the cam 114 does not rotate to another tuning position during very aggressive play. In operation, as the adjustment screw 112 is rotated the separator lever 100 bears against the cam 114 thereby raising the tuning lever 98 upwardly (assuming a starting position as shown in FIG. 3A). The tuning lever 98 pivots about the axle 102 causing the stirrup 90 to contact the head of screw 82 at the leverage point 94. The separator lever 100 pivots about the axle 102 to generate a space between the two levers 98 and 100.

As the tuning lever 98 is rotated in a clockwise direction, the stirrup 90 acts against the biasing force of the compression spring 86 to rotate the block 66 counterclockwise which in turn increases the tension in the string 20. If the adjustment screw 112 is rotated back to its original position (counterclockwise rotation) the stirrup 90 releases it force at the leverage point 94 and the block 66 is rotated in a clockwise direction, by virtue of the force from the spring 86, to decrease the tension in the string 20.

The tuning set screws 118 are also used to rotate the lever assembly 96. The access region 108 in the levers 98 and 100 is large enough to receive an allen wrench or equivalent (not shown) to gain access to the head of the set screw 118, but not large enough to actually receive the set screw head itself. This can best be seen in FIG. 3F.

Therefore, by rotating the set screw 118 to the point where it protrudes from the activator cam 114 it will bear against the separator lever 100 and cause the entire lever assembly 96 to rotate about the main axle 102 thereby increasing or decreasing the tension in the string 20 in the same way as discussed above in connection with the adjustment screw 112. The adjustment screw 112 can be in any position without affecting the independent operation of the set screws 118.

Consequently, by virtue of the compound lever assembly 96, the tension in the string 20 can be changed independently by both the adjustment screw 112 and by the set screws 118.

To "program" various pitch tunings for each string the following steps are performed:

(a) secure one of the strings 20 to the clamping. apparatus 62 by rotating clamp screw 82 such that the ball bearing 84 clamps the string 20 against the vertical portion 78 of block 66;

(b) employ the fine tuning adjustment screw 112 to obtain an accurate pitch tuning, generally termed the base tuning (or root position, which is the slackest tuning of the string); one of the set screw positions is reserved for this base tuning and is fully recessed in the cam 114;

(c) repeat steps (a) and (b) for all strings on the instrument;

(d) rotate the cam 114 by using the cam rotation lever 115 to the next set screw position;

(e) adjust the set screw 118 corresponding to the set screw position by inserting a tool through the set screw access region 108 in the levers 98 and 100; the screw 118 is adjusted to rotate the lever assembly 96 to either increase or decrease the tension in the string 20 relative to the previously established pitch tuning;

(f) repeat steps (d) and (e) for all the strings of the instrument; and (g) repeat steps (d)-(f) to program all set screw positions by raising or lowering the respective set screw 118; in the case of the cam 114 of FIG. 3B, three custom pitch tunings can be accommodated (in addition to the base tuning of step (b)) and in the case of the cam 114 of FIG. 3C, five custom pitch tunings can be accommodated (in addition to the base tuning of step (c)).

To "recall" the various pitch tunings that were previously programmed the following step is performed:

(a) rotate the cam 114 by using the cam rotation lever 115 to the desired set screw position; the set screws 118 at that position will automatically tension all of the strings 20 according to the preset levels.

Figure 3D:
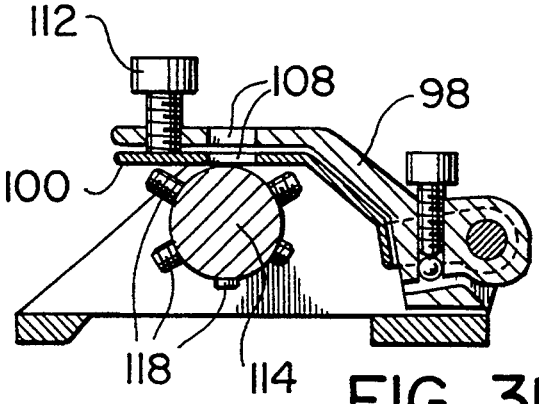
FIGS. 3D and 3E are cross-sectional views of the activator cam of FIG. 3C at two distinct pitch tuning positions.
Figure 3E:
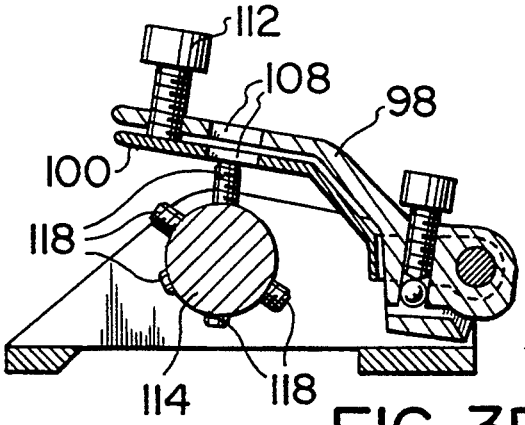
Figure 3F:
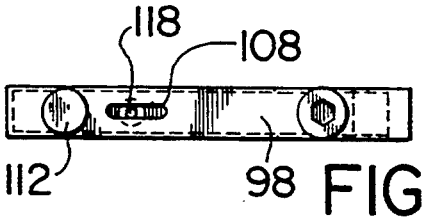
FIG. 3F is a top plan view of the lever assembly of the system of FIG. 3A.

A schematic representation of the cam 114 interacting with the lever assembly 96 during a recall is illustrated in FIGS. 3D and 3E. Specifically, FIG. 3D shows cam 114 at the root tuning position with the set screw 118 fully recessed in the cam 114. As the cam 114 is rotated by the cam rotation lever 115 another set screw 118, which was previously programmed to a desired pitch tuning, pushes the lever assembly 96 upward thereby causing the string 20 tension to increase to the desired level. The cam 114 can be rotated in either direction to recall the desired programmed setting.

Figure 4:
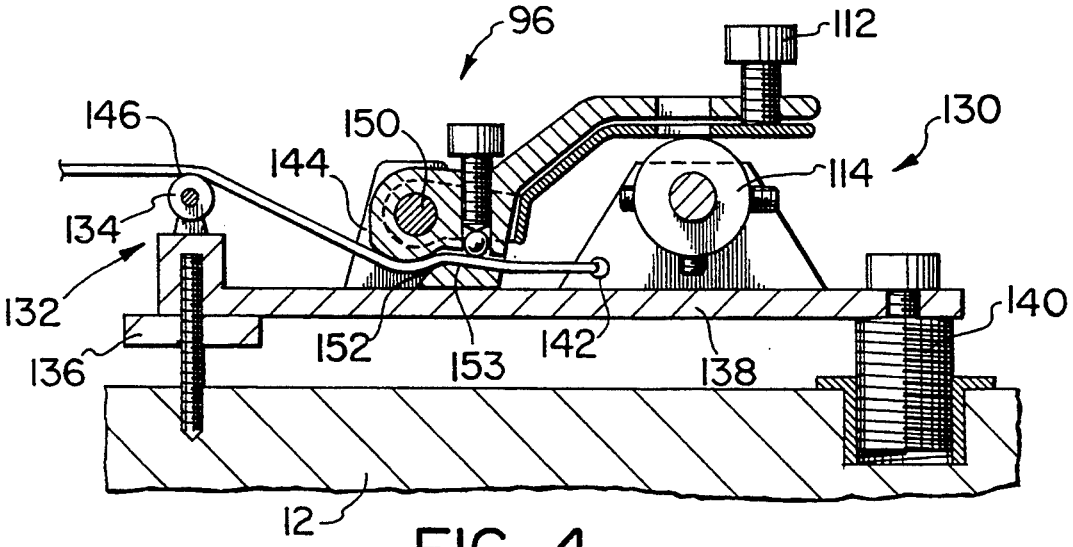
FIG. 4 is a cross-sectional view of a single non-clamping bridge tuning unit of a non-clamping bridge memory tuning system.

FIG. 4 shows a non-clamping bridge memory tuning unit 130 according to another embodiment of the present invention. In this embodiment the entire clamping apparatus 62 is eliminated. The non-clamping bridge memory tuning unit 130 can be mounted on the guitar 10 by replacing the existing bridge 22 with the a plurality of non-clamping bridge units 130 (one unit 130 for each string on the instrument), which incorporates the basic bridge structure.

A roller-bridge 132 is substituted for the clamping apparatus 62 used in the embodiment of FIG. 3A. The bridge 132 includes a circular string guide 134 mounted to a frame assembly 136 that is connected to the body 12 of the guitar 10. A support member 138 is positioned between the frame assembly 136 and an anchor assembly 140. The string 20 having an eyelet 142 at one end is mounted over the guide 134 and secured to an extension 144 of the support member 138.

The critical contact point for the non-clamping bridge tuning unit 130 occurs in the vicinity of the top of the string guide 134 at approximately a point 146. The other critical contact point is unchanged at the nut element 16 of guitar 10.

The lever assembly 96 comprising the levers 98 and 100 are rotatably mounted to a lever axle 150. The standard lever 98 varies from that of FIG. 3A only in terms of a string bearing member 152 that extends from one end of the lever 98 and engages the string 20 at a curved surface portion 153. The bearing member 152 acts to increase or decrease the tension on the string 20 as the lever assembly 96 is rotated by the adjustment screw 112 or by the tuning set screws 118 in the same manner as the bridge unit 60 discussed in conjunction with FIG. 3A.

Figure 5:
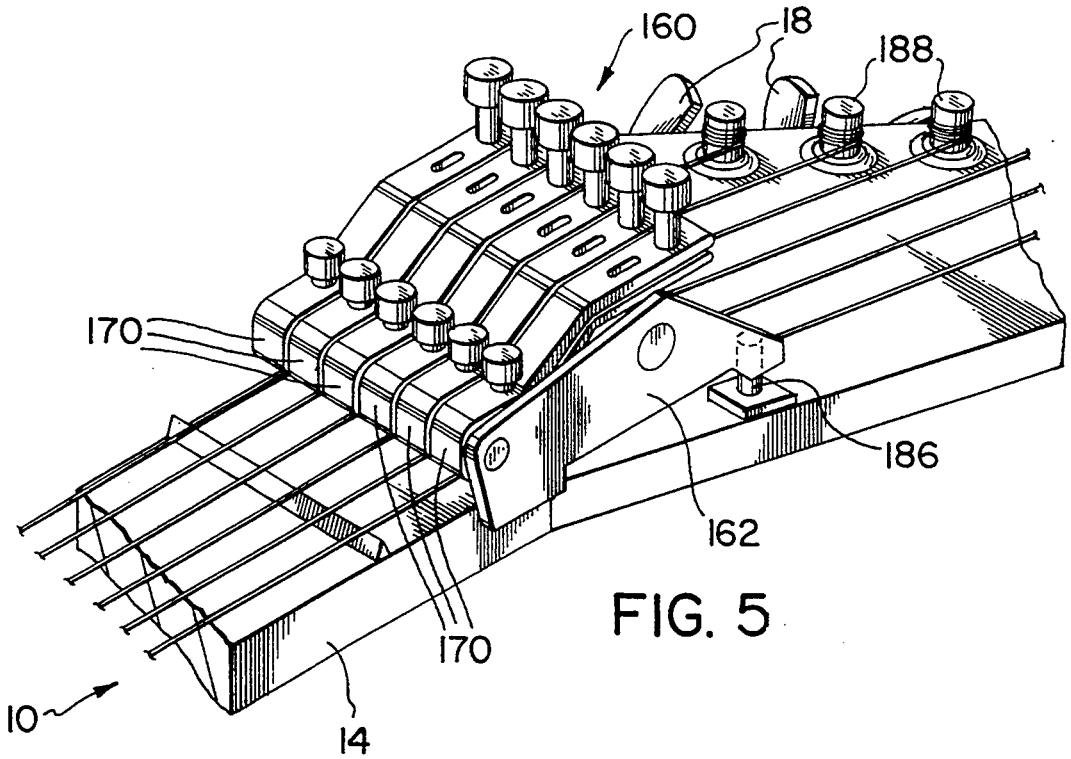
FIG. 5 is a perspective view of a nut memory tuning system mounted at the nut of the guitar.

FIG. 5 shows a nut memory tuning system 160 that is mounted at the neck 14 and headstock 19 of the guitar 10 and incorporates the nut 16 structure. In this embodiment the tremolo apparatus 32 can be located at the bridge 22 but is not required for the system 160 to function.

The nut memory tuning system 160 includes a plurality of nut tuning units 170 each of which is independently interconnected to one of the strings 20 of the guitar 10. An individual nut tuning unit 170 will be discussed in detail in conjunction with FIG. 6.

Referring specifically to FIG. 5, the present embodiment includes a plate frame assembly 162 that retains and secures the individual tuning units 170. The frame 162 is anchored to the neck 14 and headstock 19 of guitar 10 by a series of frame screws 164 (best seen in FIG. 6).

The individual tuning unit 170 will be discussed with reference to FIG. 6. The lever assembly 96 comprising the levers 98 and 100 are rotatably mounted to a lever axle 172.

The standard lever 98 varies from that of FIG. 3A only in terms of a string bearing member 174 that extends from one end of the lever 98 and engages the string 20 at a curved surface portion 176. The bearing member 174 acts to increase or decrease the tension on the string 20 as the lever assembly 96 is rotated by the adjustment screw 112 or by the tuning set screws 118 of the cam 114 in the same manner as the bridge unit 60 describe in conjunction with FIG. 3A.

In the present embodiment, the string 20 is clamped by a clamping screw 178 and ball bearing 180 which are positioned in a threaded aperture 182 located through the member 174. The string 20 is pressed between the ball bearing 180 and a clamping block 184 of the member 174. The string 20 extends from its clamped location to a stabilizer and intonation fine adjustment assembly 186 and is finally secured around a standard tuning machine 188. The stabilizer 186 is used to ensure the string 20 is oriented properly in the clamping block 184.

The critical contact point for nut tuning unit 170 occurs in the vicinity of the bearing member 174 at approximately a point 190. The other critical contact point is unchanged at the bridge element 22 of guitar 10.

Figure 7:
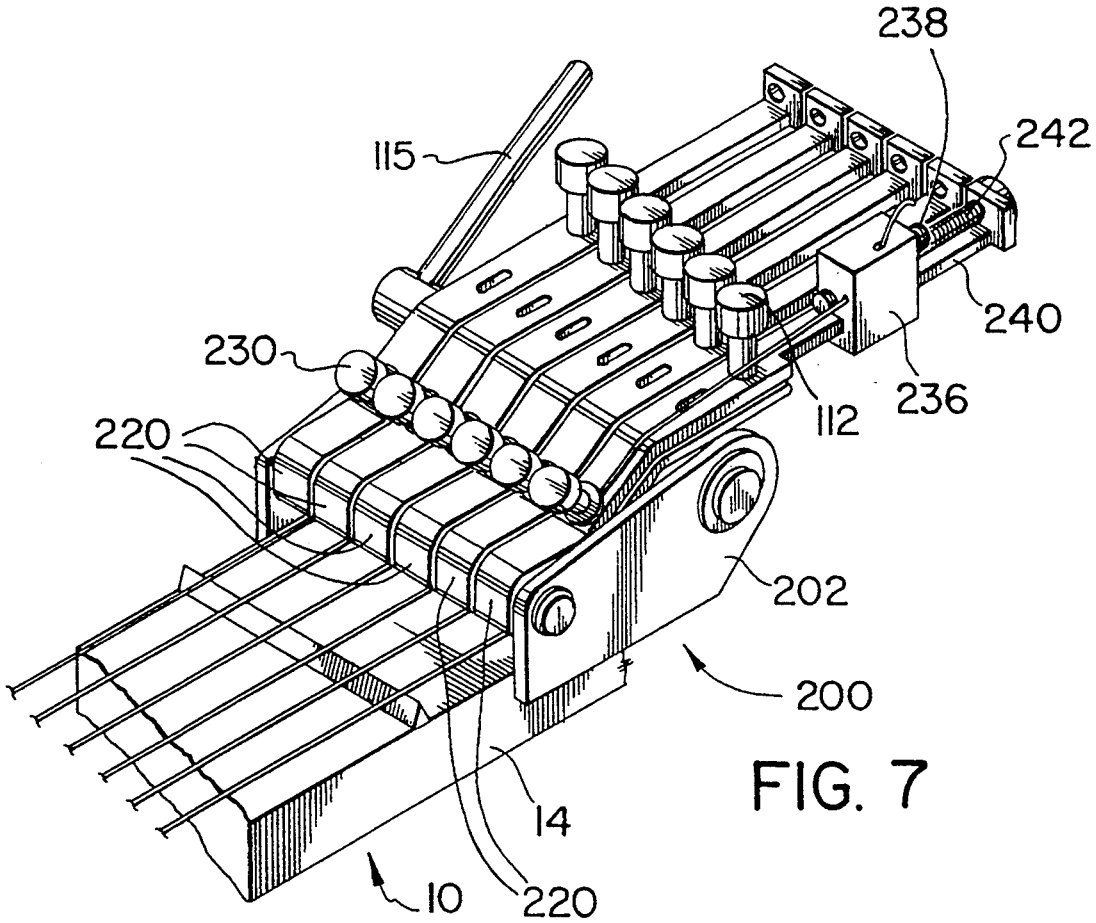
FIG. 7 is a perspective view of a nut memory tuning system mounted at the nut of the guitar incorporating both a fine and coarse tuning adjustment.
Figure 8A:
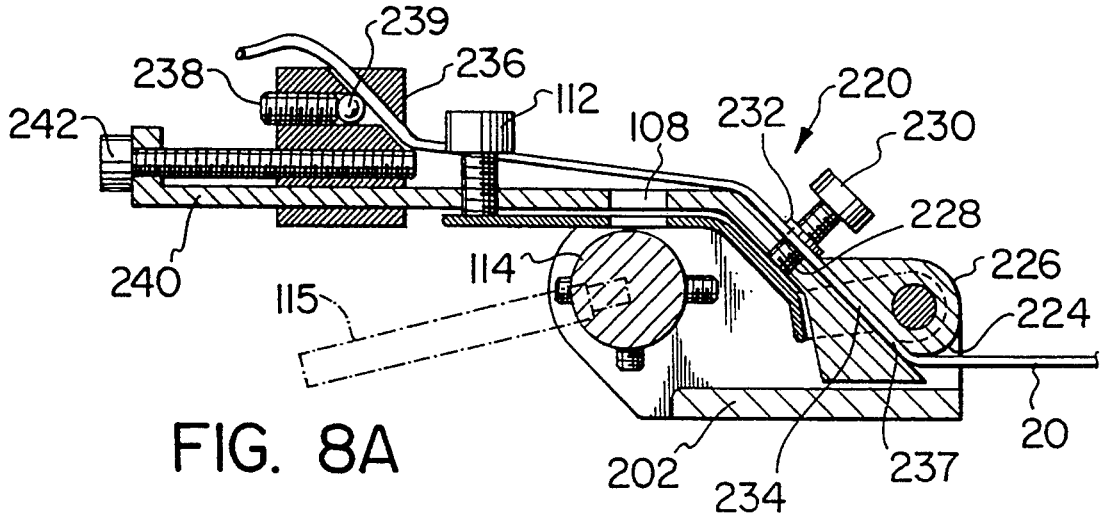
FIG. 8A is a cross-section view of a single nut memory tuning unit of the nut memory tuning system illustrated in FIG. 7.
Figure 8B:
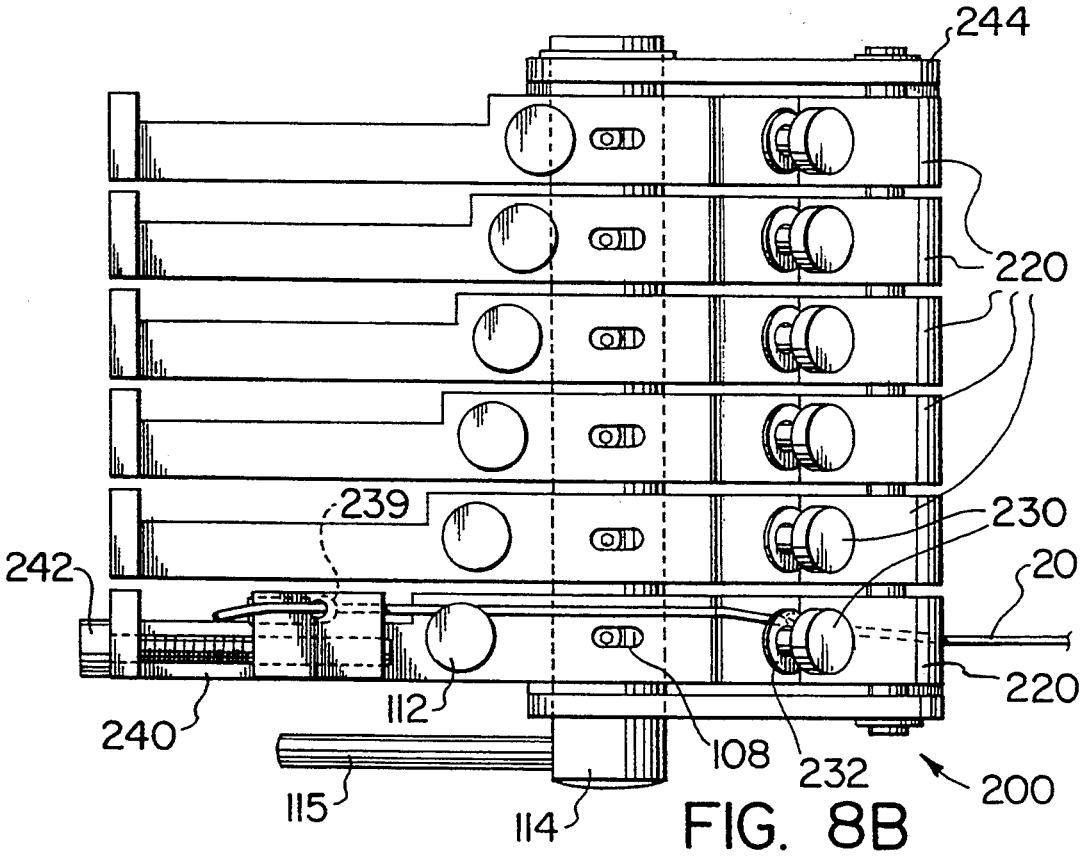
FIG. 8B is a top plan view of the nut memory tuning system illustrated in FIG. 7.

FIGS. 7 and 8B show a nut memory tuning system 200 with fine and coarse tuning adjustment that is mounted at the neck 14 of the guitar 10 and incorporates the nut element 16. In this embodiment the entire headstock 19 can be eliminated since the tuning pegs 18 are rendered obsolete by the coarse tuning feature. In this embodiment the tremolo apparatus 32 can be located at the bridge 22 but is not required for the system 200 to function.

The nut memory tuning system 200 includes a plurality of nut tuning units 220 each of which is independently interconnected to one of the strings 20 of the guitar 10. An individual nut tuning unit 220 will be discussed in detail in conjunction with FIG. 8A.

Referring specifically to FIGS. 7 and 8B, the present embodiment includes a plate frame assembly 202 that retains and secures the individual tuning units 220. The frame 202 is anchored to the neck 14 of guitar 10 by a series of screws (not shown) with the headstock 19 removed.

The individual tuning unit 220 will be discussed with reference to FIG. 8A. The string 20 is threaded through a guide slot 224 of a clamping block 226, which is an extension of the lever 98. A threaded aperture 228 houses a clamping screw 230. The screw 230 is threaded downwardly against a washer 232 to force the string 20 against a portion 234 of the lever 98.

The clamping block 226 includes a string bearing surface 237 that acts to increase or decrease the tension on the string 20 as the lever assembly 96 is rotated about lever axle 222. The lever assembly 96 rotation is controlled by the adjustment screw 112 or by the tuning set screws 118 of the cam 114 in the same manner as the bridge unit 60 described in conjunction with FIG. 3A.

The string 20 extends to a string end clamp block 236 in which the string is clamped by a clamping screw 238 and a ball bearing 239. The string end clamp block 236 rides on a track 240 in which a coarse tuning screw 242 is used to tighten and loosen the string 20. The coarse tuning screw 242 essentially replaces the tuning pegs 18 of a typical guitar.

The critical contact point for nut tuning unit 220 occurs in the vicinity of the member 226 at approximately a point 244. The other critical contact point is unchanged at the bridge element 22 of guitar 10.

Once the string 20 is coarsely tuned by adjusting the position of the clamp block 236 on the track 240 by use of the tuning screw 242, the pitch tuning programming is accomplished in the same manner as discussed in conjunction with the bridge unit of FIG. 3A.

The fine tuning screws 112 are shown oriented at an angle (in plan) to compensate for size variations of the strings 20. For example, for the larger strings (near the bottom of FIG. 8B) the set screw 112 is set at the furthest point on the lever 98, and for the smaller strings (near the top of FIG. 8B) the set screw 112 is shown very close to the access region 108.

Figure 8C:
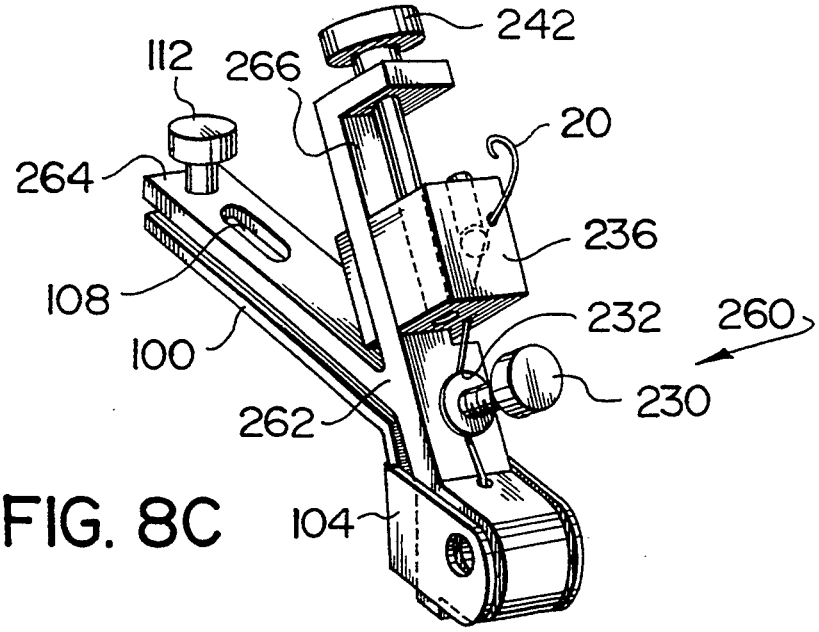
FIG. 8C is a perspective view of a Y-lever assembly incorporating a coarse tuning adjustment.

FIG. 8C illustrates a Y-lever arrangement 260 wherein the tuning lever 98 is split at a junction point 262 to comprise two portions 264 and 266. The portion 266 includes the coarse tuning screw 242 and the block 236. The entire system of levers shown in FIG. 8B could be replaced with several levers 260 for certain applications; specifically, where the thickness of the system is not a concern.

Figure 6:
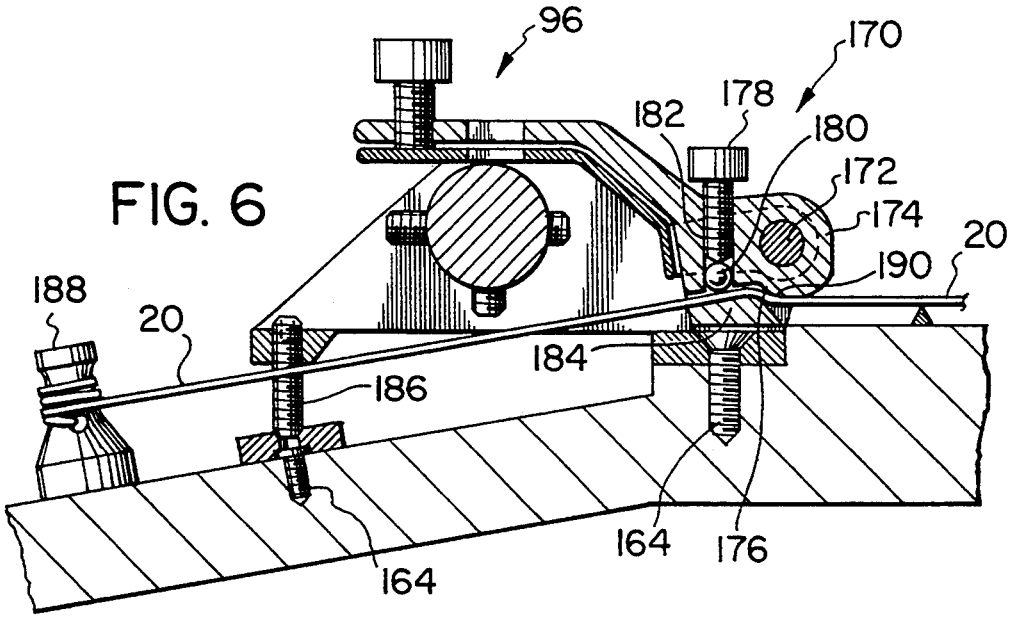
FIG. 6 is a cross-sectional view of a nut tuning unit of the nut memory tuning system of FIG. 5.
Figure 9:
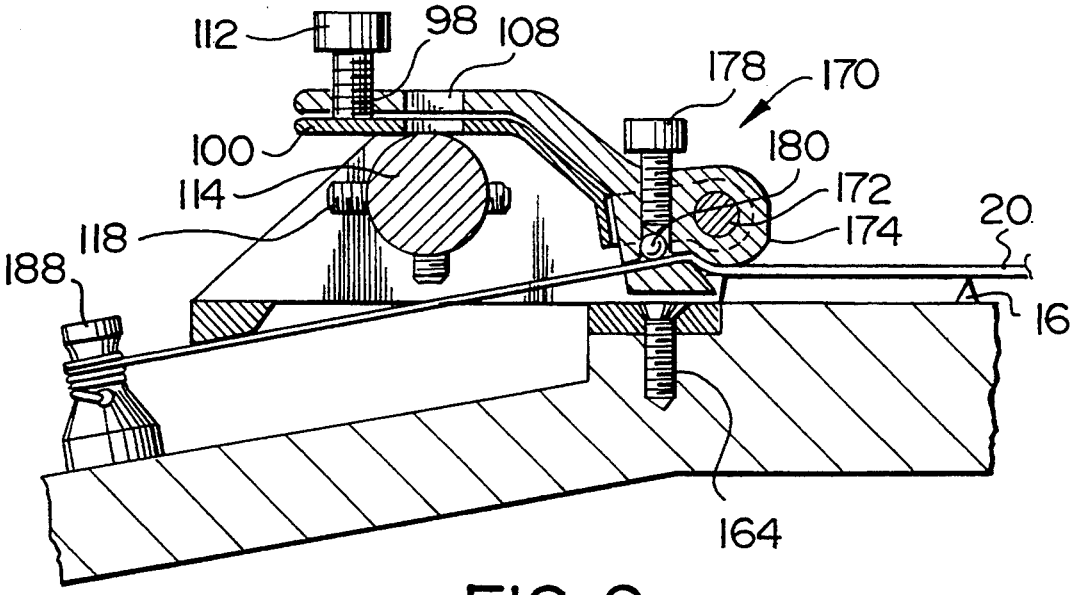
FIG. 9 is a cross-sectional view of a single clamping nut memory tuning unit located proximate the intonation point.

FIG. 9 shows the nut tuning unit 170, of FIG. 6, mounted between the actual nut element 16 of guitar 10 and the tuning machine 188. In this embodiment the nut element 16 continues to act as the intonation point (critical contact point) for the string 20 with the tuning unit 170 providing the required means to change the tension of the string 20 in the same manner discussed with the tuning unit 170 of FIG. 6.

The present invention, whether mounted at or near the nut or bridge; or with or without a tremolo apparatus, can be programmed to simply and quickly recall a desired pitch tuning by merely rotating the cam 114 to engage a given set of set screws 118 against the lever assemblies 96 to change the tension of the strings 20.

The embodiments of the invention in which an exclusive property or privilege is claimed are defined as follows:

1. A memory tuning system for a stringed instrument, wherein the stringed instrument includes a plurality of strings that are pre-tensioned between two critical contact points, said memory tuning system comprising:

a frame assembly for connection to said instrument;

a plurality of string contact members connected to the frame assembly, said plurality of string contact members contacting said strings proximate and outside one of the contact points;

a plurality of tuning levers each pivotally connected to the frame assembly and each operatively connected to a respective one of the string contact members;

a plurality of separator levers each pivotally connected to the frame assembly and each operatively connected to a respective one of the tuning levers; and a cam member rotatable mounted to the frame assembly and contacting the separator levers for pivoting the tuning levers and the separator levers, said cam member having a plurality of spaced apart adjustable projection elements.

2. The memory tuning system of claim 1, further including a plurality of fine tuning adjustment screws each tapped through a respective one of the tuning levers, each of the adjustment screws being adapted to act against a respective one of the separator levers when rotated.

3. The memory tuning system of claim 1 or 2, further including cam locking means for locking the cam member in a fixed position.

4. The memory tuning system of claim 1 or 2, further including cam rotation means for rotating the cam member.

5. The memory tuning system of claim 1, further including a plurality of string securing means each connected to the frame assembly for stabilizing a respective one of said strings.

6. The memory tuning system of claim 5, wherein each of the string securing means includes:

a base block element connected to the frame assembly;

a string retaining block connected to the base block element, said string retaining block having a string receiving region and a clamping means for retaining the respective one of said strings within the string retaining block.

7. The memory tuning system of claim 5, wherein each of the string securing means includes string guide means mounted to the frame assembly for receiving a portion of the respective one of said strings; and string end locking means mounted to the frame assembly and proximate the string guide means for fixing one end of the respective one of said strings.

8. The memory tuning system of claim 5, wherein each of the string securing means includes:

a housing having an aperture for receiving the respective one of said strings; and clamping means for retaining the respective one of said strings within the housing.

9. The memory tuning system of claim 5, wherein each of the string securing means includes:

a first housing mounted on the frame assembly having an aperture for receiving the respective one of said strings at an intermediate portion thereof;

first clamping means for retaining the respective one of said strings within the first housing;

a second housing mounted on the frame assembly located aft of the first housing for receiving an end portion of the respective one of said strings; and second clamping means for retaining the respective one of said strings within the second housing.

10. The memory tuning system of claim 9, wherein the second housing being further mounted on a track member for lateral movement thereon.

11. The memory tuning system of claim 1, wherein the adjustable projection elements include set screws, each of the set screws having a slotted head portion.

12. The memory tuning system of claim 11, wherein the tuning levers and the separator levers include access apertures for gaining access to the slotted head portion of one of the set screws.

13. A memory tuning system for a stringed instrument having a plurality of strings, wherein each of the strings makes contact with the instrument at two critical contact points, said memory tuning system comprising a frame assembly adapted to be mounted on the instrument and a plurality of memory tuning units connected to the frame assembly, one of said tuning units for each of the plurality of strings of the instrument, said memory tuning unit comprising:

(a) string securing means connected to the frame assembly for retaining a respective one of said strings proximate one of the critical contact points;

(b) tension control means for changing the tension of the respective one of said strings;

(c) a tuning lever pivotally connected to the frame assembly and operatively connected to the tension control means;

(d) a separator lever pivotally connected to the frame assembly and operatively connected to the tuning lever; and (e) a cam member rotatably mounted to the frame and contacting the separator lever for rotating the tuning lever, said cam member having a plurality of adjustable projection elements spaced around the cam member.

14. The memory tuning system of claim 13, wherein the string securing means includes:

a base block element connected to the frame assembly;

a string retaining block connected to the base block element, said string retaining block having a string receiving region and a clamping means for retaining the respective one of said strings within the string retaining block.

15. The memory tuning system of claim 14, wherein the clamping means includes a clamping screw having a string bearing surface, said clamping screw being threaded through the string retaining block.

16. The memory tuning system of claim 15, further including a ball bearing located at the string bearing surface of the clamping screw.

17. The memory tuning system of claim 14, wherein the tension control means includes:

means for rotating the string retaining block relative to the base block element;

biasing means for urging the string retaining block to a string receiving position;

stirrup means connected to the rotatable block element for counteracting the biasing means, and thereby altering the string tension.

18. The memory tuning system of claim 13, wherein the string securing means includes string guide means mounted to the frame assembly for receiving a portion of the respective one of said strings and string end locking means mounted to the frame assembly and proximate the string guide means for fixing one end of the respective one of said strings.

19. The memory tuning system of claim 18, wherein the tension control means includes:

a string bearing member pivotally connected to the frame between the string guide means and the string end locking means, for making contact with the respective one of said strings to alter the tension thereof.

20. The memory tuning system of claim 18, wherein the string guide means comprises a rotatable circular wheel.

21. The memory tuning system of claim 13, wherein the string securing means includes:

a housing having an aperture for receiving the respective one of said strings; and clamping means for retaining the respective one of said strings within the housing.

22. The memory tuning system of claim 21, wherein the clamping means includes a clamping screw having a string bearing surface, said clamping screw being threaded through the housing.

23. The memory tuning system of claim 22, further including a ball bearing located at the string bearing surface of the clamping screw.

24. The memory tuning system of claim 21, wherein the tension control means includes:

means for rotating the housing relative to the respective one of said strings; and a string bearing member connected to said housing for making contact with the respective one of said strings to alter its tension.

25. The memory tuning system of claim 13, wherein the string securing means includes:

a first housing mounted on the frame assembly having an aperture for receiving the respective one of said strings at an intermediate portion thereof;

first clamping means for retaining the respective one of said strings within the first housing;

a second housing mounted on the frame assembly located aft of the first housing for receiving an end portion of the respective one of said strings; and second clamping means for retaining the respective one of said strings within the second housing.

26. The memory tuning system of claim 25, wherein the tension control means includes:

means for rotating the first housing relative to the respective one of said strings; and a string bearing member connected to the first housing for making contact with the respective one of said strings to alter the tension in the respective one of said strings.

27. The memory tuning system of claim 25, wherein the second housing being further mounted on a track member for lateral movement thereon.

28. The memory tuning system of claim 27, wherein the first and second clamping means each include a clamping screw having a string bearing surface, said clamping screw being threaded through the first housing and the second housing.

29. The memory tuning system of claim 28, further including a ball bearing located at each of the string bearing surfaces of the clamping screws.

30. The memory tuning system of claim 13, further including a fine tuning adjustment screw tapped through the tuning lever, the adjustment screw being adapted to act against the separator lever when rotated.

31. The memory tuning system of claim 13, further including cam locking means for locking the cam member in a fixed position.

32. The memory tuning system of claim 13, further including cam rotation means for rotating the cam member.

33. The memory tuning system of claim 32, wherein the cam rotation means include a lever connected to the cam member.

34. The memory tuning system of claim 13, wherein the adjustable projection elements include set screws, each of the set screws having a slotted head portion.

35. The memory tuning system of claim 34, wherein the tuning lever and the separator lever each include an access aperture for gaining access to the slotted head portion of one of the set screws.

* * * * *